US006474967B1

(12) United States Patent
Haynes et al.

(10) Patent No.: US 6,474,967 B1
(45) Date of Patent: Nov. 5, 2002

(54) BREAKER PLATE ASSEMBLY FOR PRODUCING BICOMPONENT FIBERS IN A MELTBLOWN APPARATUS

(75) Inventors: Bryan D. Haynes, Cumming, GA (US); Darryl Clark, Alpharetta, GA (US); Matthew Lake, Cumming, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/573,712

(22) Filed: May 18, 2000

(51) Int. Cl.[7] ..... D01D 5/30

(52) U.S. Cl. ..... 425/7; 425/72.2; 425/131.5; 425/192 S; 425/198; 425/199; 425/463

(58) Field of Search ..... 425/131.1, 131.5, 425/192 S, 463, 7, 72.2, 198, 199; 264/172.13, 172.14, 172.15

(56) References Cited

U.S. PATENT DOCUMENTS

| | | | |
|---|---|---|---|
| 3,200,440 | A | 8/1965 | Bryan et al. |
| 3,237,245 | A | 3/1966 | Nonami et al. |
| 3,245,113 | A | 4/1966 | Sulich |
| 3,425,091 | A | 2/1969 | Ueda et al. |
| 3,584,339 | A | 6/1971 | Kamachi et al. |
| 3,601,846 | A | 8/1971 | Hudnall |
| 3,730,662 | A | 5/1973 | Nunning |
| 3,787,162 | A | 1/1974 | Cheetham |
| 3,981,650 | A | 9/1976 | Page |
| 4,052,146 | A | 10/1977 | Sternberg |
| 4,167,384 | A | 9/1979 | Shirato et al. |
| 4,251,200 | A | 2/1981 | Parkin |
| 4,293,516 | A | 10/1981 | Parkin |
| 4,308,004 | A | 12/1981 | Chion et al. |
| 4,358,375 | A | 11/1982 | Wood |

(List continued on next page.)

FOREIGN PATENT DOCUMENTS

| | | | |
|---|---|---|---|
| EP | 0474421 | A | 3/1992 |
| EP | 0646663 | A1 | 4/1995 |
| EP | 0553419 | B1 | 6/1997 |
| EP | 0561612 | B1 | 7/1997 |
| EP | 0786543 | A1 | 7/1997 |
| JP | 02182911 | | 7/1990 |
| JP | 09049115 | | 2/1997 |
| WO | 9932692 | | 7/1999 |

OTHER PUBLICATIONS

US Patent Application Serial No. 09/573,865 filed May 18, 2000 (KCX–299).

PCT Search Report dated Nov. 6, 2001.

*Primary Examiner*—Jan H. Silbaugh
*Assistant Examiner*—Joseph Leyson
(74) *Attorney, Agent, or Firm*—Dority & Manning, P.A.

(57) ABSTRACT

A die head assembly for producing meltblown bicomponent fibers in a meltblown apparatus includes a die tip detachably mounted to an underside of a support member. The die tip has a row of channels defined therethrough terminating at exit orifices along a bottom edge of the tip. The channels receive and combine first and second polymers conveyed from the support member. A recess is defined along the top surface of the die tip and defines an upper chamber for each of the die tip channels. A plurality of breaker plates is removably supported in the recess in a stacked configuration. An upper one of the breaker plates has receiving holes defined therein to separately receive polymers from supply passages in the support member. The remaining breaker plates have holes defined therethrough configured to divide the polymers into separately polymer streams and to direct the polymer streams into the die tip channels, the number of polymer streams corresponding to the number of holes in the lowermost breaker plate. The polymer streams combine in the channels prior to being extruded from the orifices as bicomponent polymer fibers.

18 Claims, 3 Drawing Sheets

U.S. PATENT DOCUMENTS 4,406,850 A 9/1983 Hills
4,411,852 A 10/1983 Bromley et al.
4,445,833 A 5/1984 Moriki et al.
4,526,733 A 7/1985 Lau
4,648,826 A 3/1987 Ogasawara et al.
4,717,325 A 1/1988 Fujimura et al.
4,738,607 A 4/1988 Nakajima et al.
4,846,653 A 7/1989 Beck et al.
5,035,595 A 7/1991 Nakajima et al.
5,080,569 A * 1/1992 Gubernick et al. ..... 425/72.2
5,145,689 A 9/1992 Allen et al.
5,162,074 A 11/1992 Hills
5,196,207 A * 3/1993 Koenig ..... 425/72.2
5,196,211 A 3/1993 Goossens
5,227,109 A 7/1993 Allen III et al.
5,234,650 A 8/1993 Hagen et al.
5,344,297 A 9/1994 Hills
5,366,804 A 11/1994 Dugan
5,466,410 A 11/1995 Hills
5,511,960 A 4/1996 Terakawa et al.
5,562,930 A 10/1996 Hills
5,601,851 A 2/1997 Terakawa
5,618,328 A 4/1997 Lin et al.
5,632,938 A 5/1997 Buehning, Sr.
5,632,944 A 5/1997 Blackwell
5,733,586 A 3/1998 Herwegh et al.
5,851,562 A 12/1998 Haggard et al.
5,935,883 A 8/1999 Pike
5,989,004 A 11/1999 Cook
6,120,276 A * 9/2000 Balk ..... 425/131.5
6,336,801 B1 * 1/2002 Fish et al. ..... 425/72.2

* cited by examiner

BREAKER PLATE ASSEMBLY FOR PRODUCING BICOMPONENT FIBERS IN A MELTBLOWN APPARATUS

BACKGROUND

The present invention relates to a die head assembly for a meltblown apparatus, and more particularly to a process and breaker plate assembly for producing bicomponent fibers in a meltblown apparatus.

A meltblown process is used primarily to form fine thermoplastic fibers by spinning a molten polymer and contacting it in its molten state with a fluid, usually air, directed so as to form and attenuate filaments or fibers. After cooling, the fibers are collected and bonded to form an integrated web. Such webs have particular utility as filter materials, absorbent materials, moisture barriers, insulators, etc.

Conventional meltblown processes are well known in the art. Such processes use an extruder to force a hot thermoplastic melt through a row of fine orifices in a die tip head and into high velocity dual streams of attenuating gas, usually air, arranged on each side of the extrusion orifice. A conventional die head is disclosed in U.S. Pat. No. 3,825,380. The attenuating air is usually heated, as described in various U.S. Patents, including U.S. Pat. No. 3,676,242; U.S. Pat. No. 3,755,527; U.S. Pat. No. 3,825,379; U.S. Pat. No. 3,849,241; and U.S. Pat. No. 3,825,380. Cool air attenuating processes are also known from U.S. Pat. No. 4,526,733; WO 99/32692; and U.S. Pat. No. 6,001,303.

As the hot melt exits the orifices, it encounters the attenuating gas and is drawn into discrete fibers which are then deposited on a moving collector surface, usually a foraminous belt, to form a web of thermoplastic material. For efficient high speed production, it is important that the polymer viscosity be maintained low enough to flow and prevent clogging of the die tip. In accordance with conventional practice, the die head is provided with heaters adjacent the die tip to maintain the temperature of the polymer as it is introduced into the orifices of the die tip through feed channels. It is also known, for example from EP 0 553 419 B1, to use heated attenuating air to maintain the temperature of the hot melt during the extrusion process of the polymer through the die tip orifices.

Bicomponent meltblown spinning processes involve introducing two different polymers from respective extruders into holes or chambers for combining the polymers prior to forcing the polymers through the die tip orifices. The resulting fiber structure retains the polymers in distinct segments across the cross-section of the fiber that run longitudinally through the fiber. The segments may have various patterns or configurations, as disclosed in U.S. Pat. No. 5,935,883. The polymers are generally "incompatible" in that they do not form a miscible blend when combined. Examples of particularly desirable pairs of incompatible polymers useful for producing bicomponent or "conjugate" fibers is provided in U.S. Pat. No. 5,935,883. These bicomponent fibers may be subsequently "split" along the polymer segment lines to form microfine fibers. A process for producing microfine split fiber webs in a meltblown apparatus is described in U.S. Pat. No. 5,935,883.

A particular concern with producing bicomponent fibers is the difficulty in separately maintaining the polymer viscosities. It has generally been regarded that the viscosities of the polymers passing through the die head should be about the same, and are achieved by controlling the temperature and retention time in the die head and extruder, the composition of the polymers, etc. It has generally been felt that only when the polymers flow through the die head and reach the orifices in a state such that their respective viscosities are about equal, can they form a conjugate mass that can be extruded through the orifices without any significant turbulence or break at the conjugate portions. When a viscosity difference occurs between the respective polymers due to a difference in molecular weights and even a difference in extrusion temperatures, mixing in the flow of the polymers inside the die head occurs making it difficult to form a uniform conjugate mass inside the die tip prior to extruding the polymers from the orifices. U.S. Pat. No. 5,511,960 describes a meltblown spinning device for producing conjugate fibers even with a viscosity difference between the polymers. The device utilizes a combination of a feeding plate, distributing plate, and a separating plate within the die tip.

There remains in the art a need to achieve further economies in meltblown processes and apparatuses for producing bicomponent fibers from polymers having distinctly different viscosities.

SUMMARY OF THE INVENTION

Objects and advantages of the invention will be set forth in the following description, or may be apparent from the description, or may be learned through practice of the invention.

The present invention relates to an improved die head assembly for producing bicomponent meltblown fibers in a meltblown spinning apparatus. It should be appreciated that the present die head assembly is not limited to application in any particular type of meltblown device, or to use of any particular combination of polymers. It should also be appreciated that the term "meltblown" as used herein includes a process that is also referred to in the art as "meltspray."

The die head assembly according to the invention includes a die tip that is detachably mounted to an elongated support member. The support member may be part of the die body itself, or may be a separate plate or component that is attached to the die body. Regardless of its configuration, the support member has, at least, a first polymer supply passage and a separate second polymer supply passage defined therethrough. These passages may include, for example, grooves defined along a bottom surface of the support member. The grooves may be supplied by separate polymer feed channels.

The die tip has a row of channels defined therethrough that terminate at exit orifices or nozzles along the bottom edge of the die tip. These channels receive and combine the first and second polymers conveyed from the support member.

An elongated recess is defined in the top surface of the die tip. This recess defines an upper chamber for each of the die tip channels. A plurality of elongated breaker plates are disposed in a stacked configuration within the recess. The uppermost breaker plate has receiving holes defined therein to separately receive the polymers from the supply member passages. For example, in one embodiment of the uppermost breaker plate, alternating receiving holes are disposed along the upper surface of the breaker plate to separately receive the two polymers. In this embodiment, the receiving holes may be in fluid communication with distribution channels defined in the bottom of the upper breaker plate. These distribution channels are disposed so as to separately distribute the two polymers to an adjacent breaker plate. In one particular embodiment, these distribution channels are disposed across the breaker plate, or transverse to the longitudinal axis of the breaker plate. One set of the distribution channels extends about halfway across the breaker plate so as to distribute one of the polymers to a row of holes in the adjacent breaker plate. Another set of the distribution channels extends generally across the breaker plate so as to distribute the other polymer to at least one other row of holes in the adjacent breaker plate.

The remaining breaker plates have holes or channels defined therethrough configured to divide the polymers distributed by the upper breaker plate into a plurality of separate polymer streams and to direct these polymer streams into the die tip channels. Thus, at each die tip channel, the first and second polymers are conveyed from the support member supply passages, through the breaker plates, and into the die tip channels as a plurality of separate polymer streams corresponding to the number of holes in a lowermost breaker plate. The polymer streams combine in the channels prior to being extruded from the orifice as bicomponent polymer fibers.

A filter element, such as a screen, is disposed in the recess so as to separately filter the polymer streams prior to the streams being conveyed into the die tip channels. For example, this filter screen may be disposed between the bottom two breaker plates.

In one particular embodiment of the invention, three stacked breaker plates are disposed in the die tip recess and include an upper breaker plate, a middle breaker plate, and a lower breaker plate. The lower breaker plate has a grouping of holes defined therethrough at each of the die tip chambers. Thus, the lower breaker plate has a series of such groupings defined longitudinally therealong, wherein one such grouping is provided for each die tip channel. The invention is not limited to any particular number or configuration of holes defined in the lower breaker plate. For example, in one embodiment, three such holes are provided for each grouping and divide the polymers into three separate polymer streams that are combined in the die tip channels.

In the embodiment of the invention wherein three breaker plates are provided, the middle breaker plate may have a plurality of holes defined therethrough that are disposed relative to the distribution channels in the upper breaker plate so that each of the polymers is distributed to at least one of the holes in the middle breaker plate, and each of the middle breaker plate holes receives only one polymer. Thus, the polymers are not mixed in the middle breaker plate holes, and at least one of the middle breaker plate holes is used to separately convey one of the polymers. Each of the lower breaker plate holes of each grouping of holes is in fluid communication with one of the middle breaker plate holes such that each of the polymers is separately distributed to at least one of the lower breaker plate holes, and each of the lower breaker plate holes receives only one polymer. The number of lower breaker plate holes determines the number of separate polymer streams extruded into the die tip channels.

The invention will be described in greater detail below with reference to the appended figures.

DETAILED DESCRIPTION

Reference will now be made in detail to embodiments of the invention, one or more examples of which are set forth in the figures and described below. Each example is provided by way of explanation of the invention, and not meant as a limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield still a further embodiment. Thus, it is intended that the present invention include such modifications and variations.

The present invention relates to an improved die assembly for use in any commercial or conventional meltblown apparatus for producing bicomponent fibers. Such meltblown apparatuses are well known to those skilled in the art and a detailed description thereof is not necessary for purposes of an understanding of the present invention. A meltblown apparatus will be described generally herein to the extent necessary to gain an appreciation of the invention.

Processes and devices for forming bicomponent or "conjugate" polymer fibers are also well known by those skilled in the art. Polymers and combinations of polymers particularly suited for conjugate bicomponent fibers are disclosed, for example, in U.S. Pat. No. 5,935,883. The entire disclosure of the '883 patent is incorporated herein by reference for all purposes.

Figure 1:
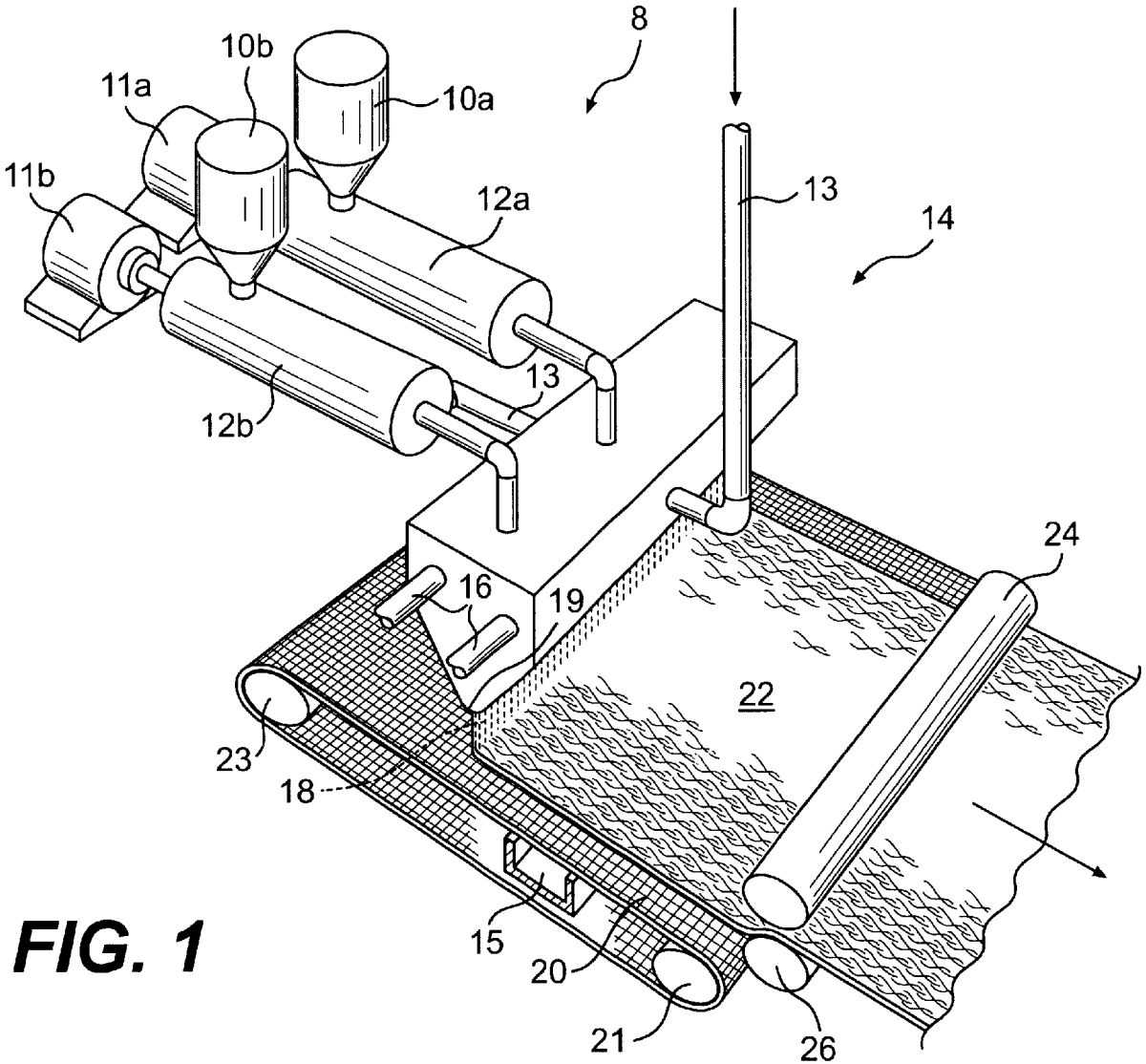
FIG. 1 is a simplified perspective view of a meltblown apparatus for producing bicomponent fibers.

Turning to FIG. 1, a simplified view is offered of a meltblown apparatus 8 for producing bicomponent polymer fibers 18. Hoppers 10*a* and 10*b* provide separate polymers to respective extruders 12*a* and 12*b*. The extruders, driven by motors 11*a* and 11*b*, are heated to bring the polymers to a desired temperature and viscosity. The molten polymers are separately conveyed to a die, generally 14, which is also heated by means of heater 16 and connected by conduits 13 to a source of attenuating fluid. At the exit 19 of die 14, bicomponent fibers 18 are formed and collected with the aid of a suction box 15 on a forming belt 20. The fibers are drawn and may be broken by the attenuating gas and deposited onto the moving belt 20 to form web 22. The web may be compacted or otherwise bonded by rolls 24, 26. Belt 20 may be driven or rotated by rolls 21, 23.

The present invention is also not limited to any particular type of attenuating gas system. The invention may be used with a hot air attenuating gas system, or a cool air system, for example as described in U.S. Pat. No. 4,526,733; the International Publication No. WO 99/32692; and U.S. Pat. No. 6,001,303. The '733 U.S. patent and international publication are incorporated herein in their entirety for all purposes.

Figure 2:
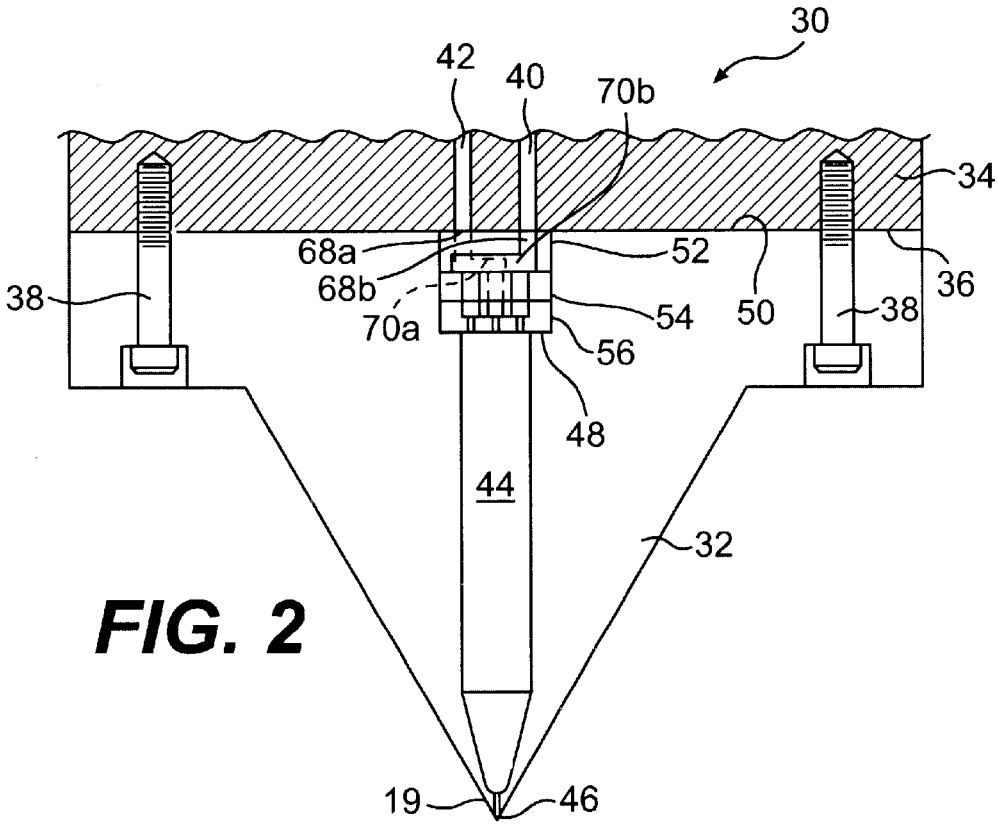
FIG. 2 is a cross-sectional view of components of a die head assembly according to the present invention.

An embodiment of a die head assembly 30 according to the present invention is illustrated in FIG. 2. Assembly 30 includes a die tip 32 that is detachably mounted to an underside 36 of a support member 34. Support member 34 may comprise a bottom portion of the die body, or a separate plate or member that is mounted to the die body. In the embodiment illustrated, die tip 32 is mounted to support member 34 by way of bolts 38.

Separate first and second polymer supply channels or passages 40, 42 are defined through support member 34. These supply passages may be considered as polymer feed tubes. Although not seen in the view of FIG. 2, the supply passages 40, 42 may terminate in elongated grooves defined along underside 36 of support member 34. Any configuration of passages or channels may be utilized to separately convey the molten polymers through support member 34 to die tip 32.

Die tip 32 has a row of channels 44 defined therethrough. Channels 44 may taper downwardly and terminate at exit nozzles or orifices 46 defined along the bottom knife edge 19 of die tip 32. Channels 44 receive and combine the first and second polymers conveyed from support member 34. In forming bicomponent fibers, the polymers do not mix within channel 44, but maintain their separate integrity and at least one interface or segment line is defined between the two polymers. Thus, the resulting fiber structure retains the polymers in distinct segments across the cross-section of the fiber. These segments run longitudinally through the fiber. Examples of various segment patterns applicable to the present invention are disclosed in U.S. Pat. No. 5,935,883.

An elongated recess 48 is defined along a top surface 50 of die tip 32. Recess 48 may run along the entire length of die tip 32. The recess 48 thus defines an upper chamber for each of the die tip channels 44.

A plurality of breaker plates are disposed in a stacked configuration within recess 48. In the embodiment illustrated, an upper breaker plate 52, a middle breaker plate 54, and a lower breaker plate 56 are provided. It should be appreciated that the invention is not limited to three such breaker plates, but may include any number of breaker plates to divide the two polymers into a desired number of separate polymer streams that are eventually extruded into each channel 44. The breaker plates have the same overall shape and dimensions and are supported within recess 48 in a stacked configuration, as particularly seen in FIG. 3. The individual breaker plates are more clearly seen in FIGS. 4, 5, and 6.

Upper breaker plate 52 has receiving holes 68*a*, 68*b* defined in a top surface 53 thereof. The receiving holes 68*a*, 68*b* are spaced apart a distance such that the holes 68*a*, 68*b* align with one of the support member supply passages 40, 42, as particularly seen in FIG. 2. In the illustrated embodiment, receiving holes 68*a*, 68*b*, alternate longitudinally along the breaker plate, as particularly seen in FIG. 4. Thus, receiving holes 68*a* align only with supply passage 42 and receiving holes 68*b* align only with supply passage 40.

Receiving holes 68*a* and 68*b* are in fluid communication with respective distribution channels 70*a*, 70*b* defined in a bottom surface of upper breaker plate 52. These distribution channels may take on any shape or configuration. In the embodiment illustrated, the distribution channels 70*a*, 70*b* extend transversely across upper breaker plate 52 relative to a longitudinal axis or direction of the breaker plate, as particularly seen in FIGS. 3 and 4. The channels have a shape and orientation so as to deliver two separate polymer streams to holes defined through middle breaker plate 54, as discussed in greater detail below.

Figure 3:
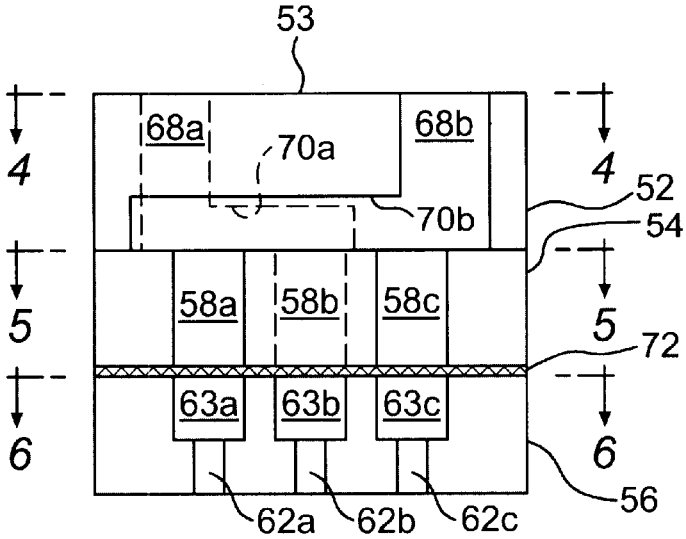
FIG. 3 is a cross-sectional view of an embodiment of the breaker plates according to the present invention.
Figure 4:
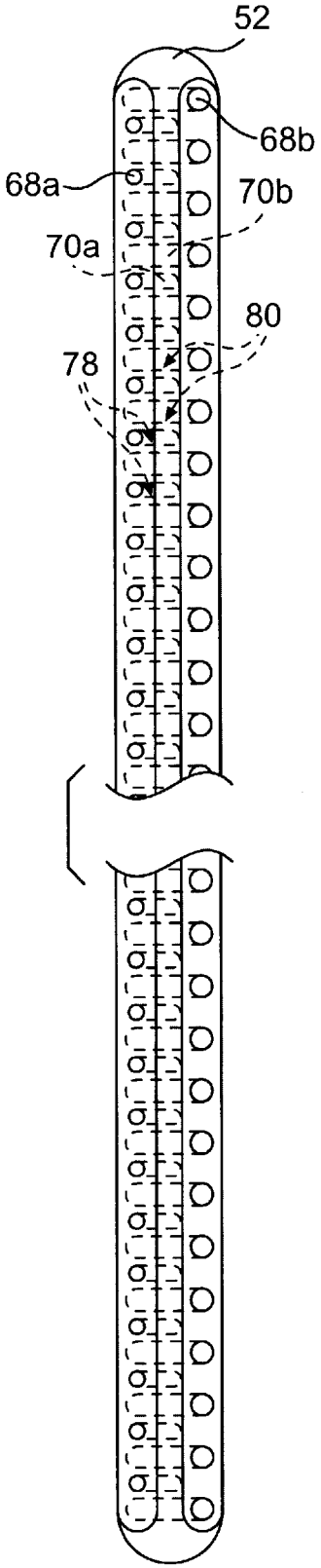
FIG. 4 is a top view of the upstream breaker plate taken along the lines indicated in FIG. 3.
Figure 5:
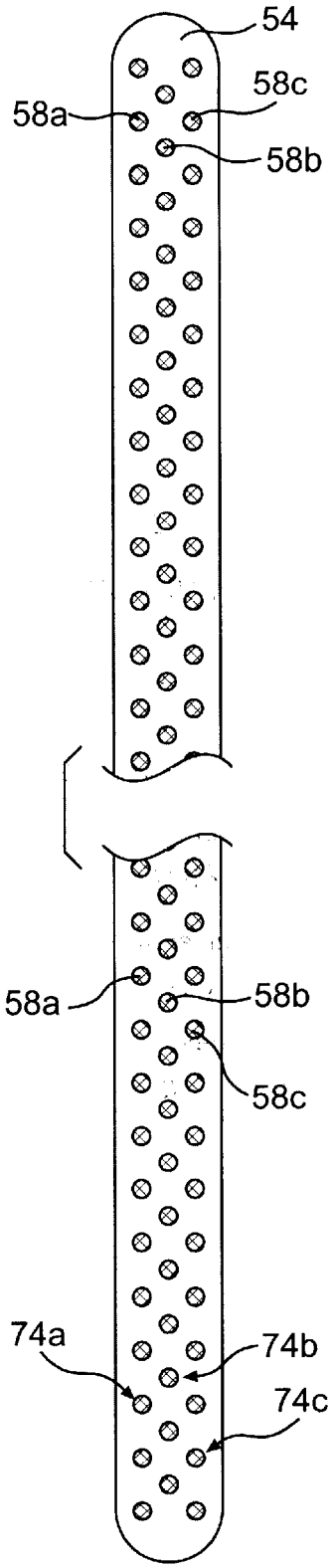
FIG. 5 is a top view of the middle breaker plate taken along the lines indicated in FIG. 3.

Middle breaker plate 54 has a plurality of holes defined therethrough for receiving the two polymers from distribution channels 70*a*, 70*b* of upper breaker plate 52. Referring particularly to FIG. 5, it can be seen that the holes are arranged in rows 74*a*, 74*b*, and 74*c*. Middle row 74*b* contains holes 58*b*. Outer rows 74*a* and 74*c* contain holes 58*a* and 58*c* respectively. The middle row 74*b* of holes 58*b* alternate longitudinally between holes 58*a* and 58*c* of the outer rows 74*a* and 74*c*. The holes 54*a*, 54*b*, and 54*c* are disposed relative to distribution channels 70*a*, 70*b* so that each of the polymers is distributed to at least one of the middle breaker plate holes, and each of the middle breaker plate holes receives only one of the polymers. For example, as can be seen in FIGS. 3 through 5, receiving holes 68*a* in upper breaker plate 52 receive the polymer from supply passage 42. Distribution channels 70*a* define a first set of distribution channels which extend about halfway across breaker plate 52 so as to distribute the polymer from supply passage 42 to the middle row 74*b* of holes 58*b* defined in middle breaker plate 54. Similarly, receiving holes 68*b* in upper breaker plate 52 receives a polymer from supply passage 40. Their respective set of distribution channels 70*b* extend transversely across upper breaker plate 52 a distance necessary to distribute the polymer to rows 74*a* and 74*c* of holes 58*a* and 58*c*, respectively. Thus, rows 74*a* and 74*c* receive the polymer from supply passage 40, and middle row 74*b* receives the polymer from supply passage 42.

Figure 6:
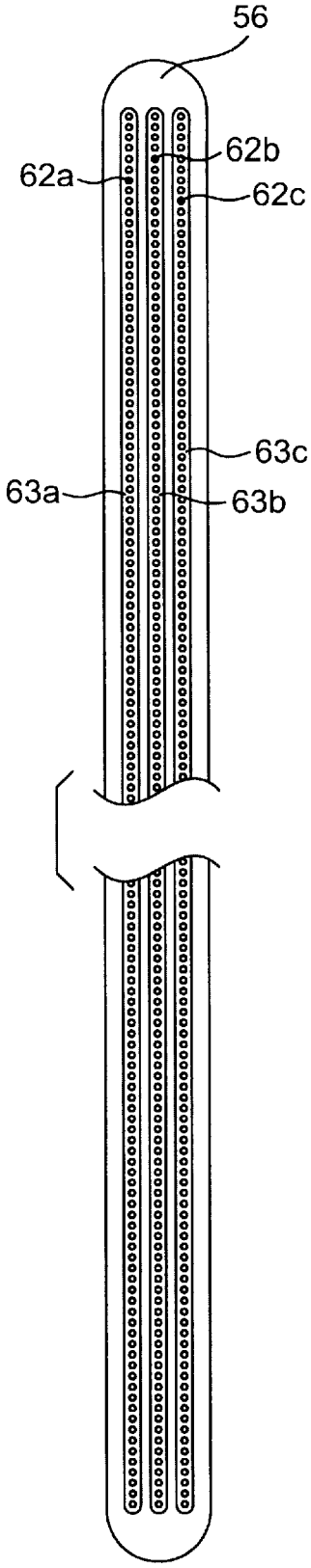
FIG. 6 is a top view of the lower breaker plate taken along the lines indicated in FIG. 3.

Lower breaker plate 56 has sets or groupings of holes defined therealong such that one group is disposed in each upper chamber of the die tip channels 44. This grouping may comprise any number of holes. In the embodiment illustrated, each grouping is defined by adjacent holes 62*a*, 62*b*, and 62*c*. Each hole 62*a*, 62*b*, 62*c* of a respective grouping at a die tip channel 44 is in fluid communication with at least one of the holes 58*a*, 58*b*, 58*c* of middle breaker plate 54 such that each of the polymers distributed to middle breaker plate 54 is subsequently distributed to at least one lower breaker plate hole, and each of the lower breaker plate holes receives only one of the polymers. Referring particularly to FIGS. 3 and 6, holes 62*a*, 62*b*, 62*c* are adjacently disposed in the bottom portion of lower breaker plate 56. Respective distribution grooves 63*a*, 63*b*, 63*c* are defined longitudinally along the upper portion of lower breaker plate 56. Thus, each of the individual holes 62*a* is in fluid communication with longitudinal groove 63*a*, each of the individual holes 62*b* is in fluid communication with longitudinal groove 63*b*, and each of the individual holes 62*c* is in fluid communication with longitudinal groove 63*c*. The middle longitudinal groove 63*b* is aligned so that middle row 74*b* of holes 58*b* in middle breaker plate 54 distribute the polymer from supply passage 42 into distribution groove 63*b*. Likewise, distribution grooves 63*a* and 63*c* are aligned with outer rows of holes 74*a* and 74*c* such that the polymer from distribution channel 40 is distributed to distribution grooves 63*a* and 63*c*. Thus, it should be understood, that at each respective die tip channel 44, three separate polymer streams will be extruded into each respective channel. The polymer streams will combine in the channels prior to being extruded as bicomponent polymer fibers. The polymers may be at a viscosity such that the individual streams maintain their integrity in the channel. The resulting fibers will thus have at least two polymer interfaces running longitudinally through the fiber.

A filter element, such as a screen 72, is disposed within recess 48 to separately filter each of the polymers prior to the polymers being extruded as separate streams into the individual channels 44. The screen 72 may be disposed between any of the breaker plates. For example, in the illustrated embodiment, screen 72 is disposed between middle breaker plate 54 and lower breaker plate 56. Screen 72 has a thickness and mesh configuration such that the polymers do not cross over or mix between the breaker plates. A 150 mesh to 250 mesh screen is useful in this regard.

The individual breaker plates 52, 54, 56 may simply rest within recess 48 in an unattached stacked configuration. In this manner, each of the breaker plates is separately and readily removable from recess 48 upon loosening or removing die tip 32 from support member 34.

Applicants have found that the construction of a die head assembly described herein allows for efficient spinning of bicomponent polymer fibers having at least two polymer segment lines or interfaces, and furthermore that spinning of such fibers is possible from polymers having significantly different viscosities without turbulence or distribution issues that have been a concern with conventional bicomponent spinning apparatuses. For example, polymers having up to about a 450 MFR viscosity difference, and even up to about a 600 MFR viscosity difference, may be processed with the present die head assembly.

It should, however, be appreciated that the resulting pattern or segment distribution of the polymers within any individual fiber is not a limitation of the invention. The segment pattern may be striped, pie-shaped, etc. In an alternative embodiment, the viscosity of one polymer distributed on either side of the other polymer may be controlled so that the one polymer merges around the inner polymer to form a core-in-sheath configuration. The metering rates of the polymers may also be precisely controlled by means well known to those skilled in the art to achieve desired ratios of the separate polymers. It should also be appreciated that the polymer segments will depend on the number, configuration, or diameter of holes in the lowermost breaker plate.

The breaker plates 52, 54, 56 preferably have a thickness so that the stacked combination of plates is supported flush within recess 48 such that upper surface 53 of upstream breaker plate 52 lies flush with, or in the same plane as, top surface 50 of die tip 32. In this embodiment, as illustrated in FIG. 2, die tip 32 can be mounted so that top surface 50 of die tip 32 lies directly against underside 36 of support member 34. Recess 48 has a width so as to encompass supply passages 42, 40 which may terminate in supply grooves defined along the underside 36 of support member 34.

It should be appreciated by those skilled in the art that various modifications and variations can be made in the present invention without departing from the scope and spirit of the invention. For example, the die head assembly according to the invention may include various hole configurations defined through the breaker plates, particularly through the lower breaker plate. Likewise, the die tip may be configured in any configuration compatible with various meltblown dies. It is intended that the present invention include such modifications and variations.

What is claimed is:

1. A die head assembly for producing meltblown bicomponent fibers in a meltblown apparatus, said assembly comprising:

a die tip detachably mountable to an underside of an elongated support member, the support member having a first polymer supply passage and a second polymer supply passage defined therethrough;

said die tip having a row of channels defined therethrough terminating at exit orifices along an edge of said die tip, said channels receiving and combining first and second polymers conveyed from the support member;

an elongated recess defined in a top surface of said die tip, said recess defining an upper chamber of each said die tip channel;

an upper breaker plate, a middle breaker plate, and a lower breaker plate removably supported in said recess, said breaker plates disposed in a stacked configuration in said recess;

said upper breaker plate having receiving holes defined in an upper surface thereof to separately receive the polymers from the supply passages in the support member and channels to separately distribute the two polymers to said middle breaker plate;

said middle breaker plate having a plurality of holes defined therethrough and disposed relative to said upper breaker plate channels so that each of the polymers is distributed to at least one said middle breaker plate hole and each said middle breaker plate hole receives only one polymer;

said lower breaker plate having groupings of holes defined therealong such that one said grouping is disposed in each said chamber of said die tip channels, each of said lower breaker plate holes in fluid communication with one of said middle breaker plate holes such that each of the polymers is distributed to at least one of said lower breaker plate holes and each of said lower breaker plate holes receives only one polymer;

a filter element disposed within said recess; and wherein at each said die tip channel, the first and second polymers conveyed from the support member supply passages flow through said breaker plates, are separately filtered by said filter element, and flow into said die tip channels as separate polymer streams corresponding to the number of said holes in said lower breaker plate and combine in said die tip channels prior to being extruded from said orifices as bicomponent polymer fibers.

2. The die head assembly as in claim 1, wherein said filter element is disposed between said lower and middle breaker plates.

3. The die head assembly as in claim 1, wherein said breaker plates are separately removable from said die tip.

4. The die head assembly as in claim 1, comprising three rows of holes in said middle breaker plate disposed in a pattern such that one said row of holes receives one polymer and the other two said rows of holes receive the other polymer from said upper breaker plate.

5. The die head assembly as in claim 4, wherein said row of holes receiving the one polymer is a middle row disposed between said other rows receiving the other polymer.

6. The die head assembly as in claim 1, wherein said lower breaker plate holes are in fluid communication with said middle breaker plate holes by way of distribution grooves defined in an upper surface of said lower breaker plate.

7. The die head assembly as in claim 6, wherein said middle breaker plate has said plurality of holes being configured in a number of rows and wherein said distribution grooves correspond in number to the number of said rows of holes in said middle breaker plate.

8. The die head assembly as in claim 7, wherein the number of holes in each said grouping of holes in said lower breaker plate corresponds to the number of distribution grooves.

9. The die head assembly as in claim 8, comprising three said holes in each said grouping of holes in said lower breaker plate.

10. The die head assembly as in claim 1, wherein said filter element comprises a mesh configuration and thickness so as to prevent crossover or mixing of the polymers between said breaker plates.

11. The die head assembly as in claim 1, wherein said upper breaker plate channels are disposed transversely across said upper breaker plate relative to a longitudinal axis thereof, one set of said upper breaker plate channels extending about half-way across said upper breaker plate so as to distribute one polymer to a middle row of said holes in said middle breaker plate, and another set of channels extending a distance so as to distribute the other polymer to outer rows of said holes in said middle breaker plate.

12. The die head assembly as in claim 1, wherein said channels of said one set alternate with those of said other set along said upper breaker plate, and said middle row of holes alternate longitudinally with said outer rows of holes in said middle breaker plate.

13. A die head assembly for producing meltblown bicomponent fibers in a meltblown apparatus, said assembly comprising:

a die tip detachably mountable to an underside of an elongated support member, the support member having a first polymer supply passage and a second polymer supply passage defined therethrough;

said die tip having a row of channels defined therethrough terminating at exit orifices along an edge of said die tip, said channels receiving and combining first and second polymers conveyed from the support member;

an elongated recess defined in a top surface of said die tip, said recess defining an upper chamber of each said die tip channel;

a plurality of breaker plates disposed in a stacked configuration within said recess, an upper one of said breaker plates having receiving holes defined therein to separately receive the polymers from the support member supply passages, the remaining said breaker plates having holes defined therethrough configured to divide the polymers into at least three separate polymer streams and to direct the polymer streams into said die tip channels; and wherein at each said channel, the first and second polymers conveyed from the support member supply passages flow through said breaker plates and into said channels as separate polymer streams corresponding to the number of said holes in the lowermost said breaker plate and combine in said channels prior to being extruded from said orifices as bicomponent polymer fibers.

14. The die head assembly as in claim 13, further comprising a filter element disposed in said recess.

15. The die head assembly as in claim 14, wherein said filter element is disposed between a bottom two adjacent said breaker plates.

16. The die head assembly as in claim 13, wherein said breaker plates comprise said upper breaker plate, a middle breaker plate, and a lower breaker plate.

17. The die head assembly as in claim 16, wherein said lower breaker plate has a grouping of at least three holes defined therethrough at each said die tip chamber, said holes in said middle breaker plate dividing the polymer streams from said upper breaker plate into three separate polymer streams delivered to said lower breaker plate holes.

18. The die head assembly as in claim 17, wherein said upper breaker plate includes distribution channels disposed so that one set of said distribution channels distributes one polymer to a middle row of holes in said middle breaker plate and another set of said distribution channels distributes the other polymer to outer rows of holes in said middle breaker plate.

* * * * *